US006135384A

United States Patent [19]

Skelly et al.

[11] Patent Number: 6,135,384

[45] **Date of Patent: *Oct. 24, 2000**

[54] DEVICE FOR DETECTING NEAR END STATE OF ROLL OF PAPER

[75] Inventors: Eamon Skelly; Kohichi Yoshida, both of Inagi, Japan

[73] Assignee: Fujitsu Isotec Limited, Tokyo, Japan

[ * ] Notice: This patent is subject to a terminal disclaimer.

[21] Appl. No.: 09/432,111

[22] Filed: Nov. 2, 1999

Related U.S. Application Data

[63] Continuation of application No. 08/297,910, Aug. 31, 1994, Pat. No. 6,024,322.

[30] Foreign Application Priority Data

Oct. 21, 1993 [JP] Japan ..... 5-263762

[51] Int. Cl.[7] ..... B65H 16/02; B65H 26/08

[52] U.S. Cl. ..... 242/563; 242/563.2; 242/595.1; 116/67 A

[58] Field of Search ..... 242/563, 563.2, 242/333, 333.5, 595, 595.1; 33/733, 750, 835; 116/67 A; 340/675, 677

[56] References Cited

U.S. PATENT DOCUMENTS

| | | | |
|---|---|---|---|
| 3,972,487 | 8/1976 | Costa | 242/563.2 |
| 4,204,180 | 5/1980 | Usui et al. | 335/205 |
| 4,447,957 | 5/1984 | Cavazza | 33/172 F |
| 5,060,877 | 10/1991 | Bullivant | 242/595.1 |
| 5,367,746 | 11/1994 | Clement et al. | 242/563 |

FOREIGN PATENT DOCUMENTS

| | | |
|---|---|---|
| 2 510 741 | 7/1982 | France . |
| 61-116573 | 6/1986 | Japan . |

*Primary Examiner*—John M. Jillions
*Attorney, Agent, or Firm*—Staas and Halsey LLP

[57] ABSTRACT

A device has a pivoted lever for detecting a near end state of a roll of paper, and the lever is held at a first position by the weight of a roll of paper, but is resiliently biased toward a second position by a spring. When the roll of paper does not have a core, and when the weight thereof falls to a predetermined value, the lever is moved from the first position to the second position due to a resilient force of the spring. When the roll of paper has a core, and when a diameter thereof is reduced to a predetermined value, the lever receives the roll of paper in a recess formed therein, and is moved from the first position to the second position due to a resilient force of the spring. When the lever is moved to the second position, this is detected by a suitable detecting element. Thus, the detector can detect the near end state of the roll of paper without regard to whether the roll of paper has a core or not.

5 Claims, 7 Drawing Sheets

DEVICE FOR DETECTING NEAR END STATE OF ROLL OF PAPER

This application is a continuation of application Ser. No. 08/297,910, filed Aug. 31, 1994, now U.S. Pat. No. 6,024, 322.

BACKGROUND OF THE INVENTION

1) Field of the Invention

The present invention relates to a device for detecting a near end state of a roll of paper in the case of using paper drawn out from a rotatably held roll of paper, and more particularly relates to a detector which can be built into a printer, facsimile, or other recording apparatus which uses a roll of paper as a recording medium. Note that the term "near end state" means the state when there is only a small amount of the roll of paper remaining.

2) Description of the Related Art

For example, a printer mounted in a terminal of a POS (point of sale) system or register uses a roll of paper as a recording paper therefor. In this case, since the roll of paper is usually held in a location where it cannot be observed, the near end state of the roll of paper cannot be visually determined by the user. Accordingly, if the time for reloading a new roll of paper in the printer is missed, the data to be recorded is lost. To avoid this situation, a detector for detecting a near end state of a roll of paper is built into the printer, and is used to notify the user when the time has come to place a new roll of paper in the printer.

There have been two types of near end state detectors in the past; one is a type which detects the diameter of the roll of paper, while the other is a type which detects the weight of the roll of paper. The former type is used mainly when the roll of paper has a core, and indicates when the diameter has been reduced to a predetermined value due to the use of the paper from the roll. The latter type is mostly used when the roll of paper has no core, and indicates when the weight of the paper falls to a predetermined value due to the use of the paper from the roll.

In the above-mentioned printer, there is a problem in that the type of roll of paper which can be used is limited by the type of the near end detector built into the printer, even though any roll of paper, having a core or not, can be used for the recording. In particular, for example, when loading a coreless roll of paper in a printer having a built-in near end detector of the type which detects the diameter of the roll of paper, accurate detection of the near end state of the roll of paper is not possible and the time for loading the new roll of paper is missed. This is because when the remaining amount of a roll of paper without a core becomes small, the portion wound in a roll loosens and the diameter of the roll appears to increase, so it is not possible to accurately detect the diameter. On the other hand, even when loading a roll of paper with a core in a printer having a built-in near end detector of the type detecting the weight of the roll of paper, it is not possible to suitably detect the near end state of the roll of paper and therefore the time for loading a new roll of paper is missed. This is because it is not possible to accurately detect the weight of the roll of paper itself due to the weight of the core of the roll.

SUMMARY OF THE INVENTION

Therefore, an object of the present invention is to provide a detector for detecting a near end state of a roll of paper when using paper drawn out from a rotatably held roll of paper, which is constructed to enable suitable detection of the near end state without regard as to whether the roll of paper has a core or not.

In accordance with the present invention, there is provided a device for detecting a near end state of a roll of paper, comprising: holding means for rotatably holding a roll of paper so as to enable paper to be drawn from the roll of paper; movable means, built into the holding means, that is movable between a first position and a second position, the movable means having a recess of predetermined dimensions and shape formed therein; elastic means for resiliently biasing the movable means from the first position to the second position; the movable means being held at the first position against an elastic force of the elastic means by a weight of the roll of paper when the roll of paper is on the holding means; in the case where the roll of paper is coreless, the movable means being moved from the first position to the second position by the elastic force of the elastic means when the weight of the roll of paper is reduced to a predetermined value by the drawing out of the paper therefrom; in the case where the roll of paper has a core, the movable means being moved from the first position to the second position by the elastic force of the elastic means when the diameter of the roll of paper is reduced to a predetermined value by the drawing out of the paper therefrom so as to be received in the recess of the movable means; and detecting means for detecting the movable means when it is moved from the first position to the second position.

The detector as mentioned above may further comprise an alarm means for warning that the remaining amount of the roll of paper has reached the near end state when the movement of the movable means from the first position to the second position is detected by the detecting means. Preferably, a position of the recess of the movable means is adjustable in accordance with a size of the core of the roll of paper with a core.

BRIEF DESCRIPTION OF THE DRAWINGS

Other objects and advantages of the present invention will be better understood from the following description, with reference to the accompanying drawings, in which.

DESCRIPTION OF THE PREFERRED EMBODIMENTS

Figure 1:
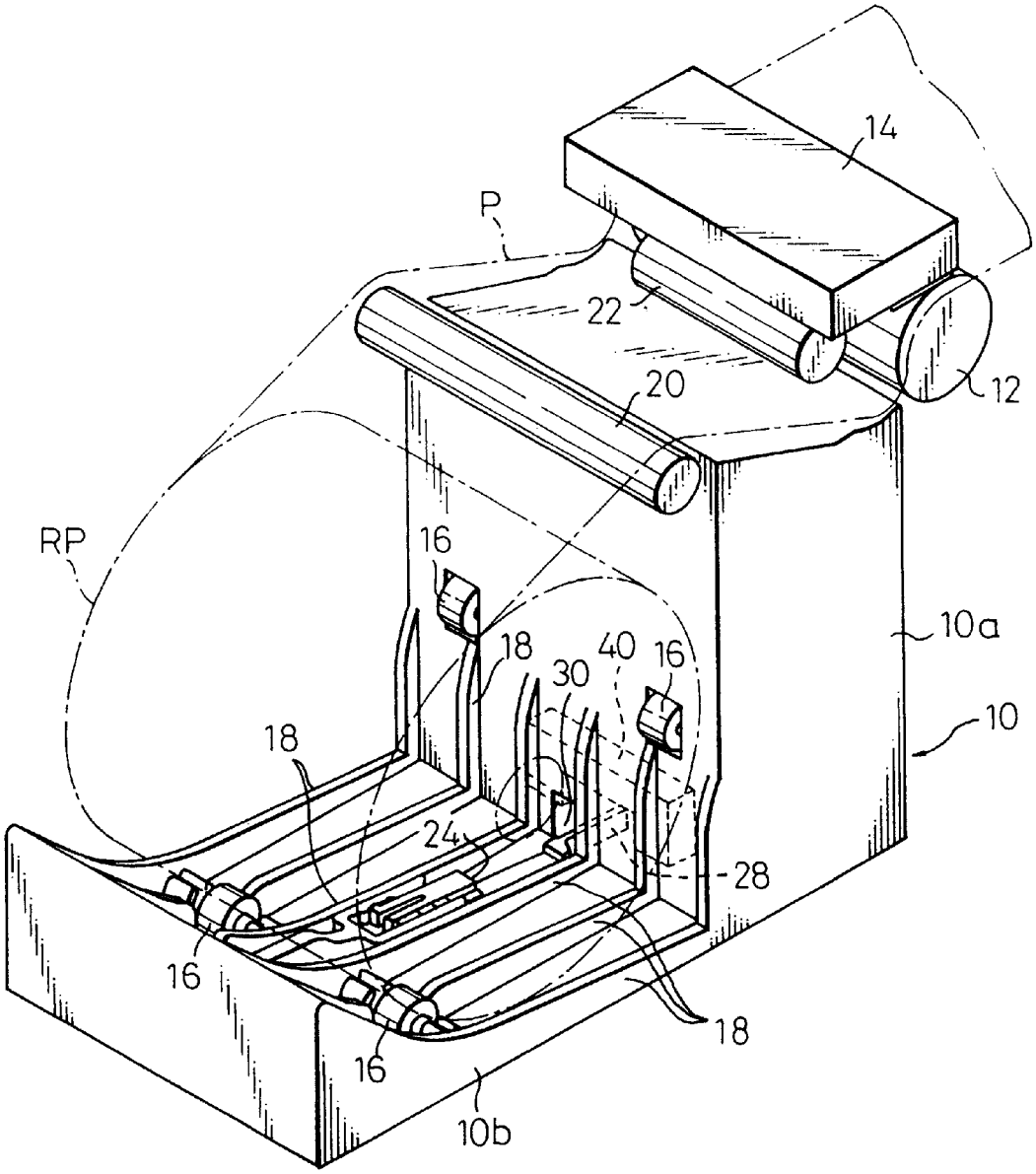
FIG. 1 is a schematic perspective view showing part of a printer mounted on a terminal of a POS system in which a device for detecting a near end state of a roll of paper according to the present invention is incorporated.

FIG. 1 schematically shows a printer mounted in a terminal of a POS system, for example. This printer is provided with a frame 10, a platen 12 disposed above the frame 10, and a thermal head 14 disposed close to and facing the platen 12. The platen 12 and the thermal head 14 are both supported by the frame 10 through a not shown suitable support structure. The frame 10 includes a standing portion 10*a* exhibiting a box-like shape and an extending portion 10*b* which extends from the bottom of the standing portion 10*a* in the horizontal direction. A roll of paper holding space is formed between the two portions 10*a* and 10*b*. A pair of support rollers 16 is disposed rotatably in each of the standing portion 10*a* and the protruding portion 10*b*. When a roll of paper RP, shown by the chain-dot line, is loaded in the roll of paper holding space, the roll of paper RP is placed on the two pairs of support rollers 16, whereby the roll of paper RP is held in a rotatable manner. Further, six rib elements 18 are provided at equal intervals between the two pairs of support rollers 16, and extend on the extending portion 10*b* in a direction perpendicular to the center axis of the roll of paper RP and rise vertically along the wall surface of the standing portion 10*a*. Note that the two rib elements positioned at the outermost sides among the six rib elements 18 are formed integrally as part of the two side walls of the frame 10.

The paper P drawn out from the roll of paper RP is guided through two guide rollers 20 and 22, and is fed to a space between the platen 12 and the thermal head 14, whereby a recording is made on the paper P by the thermal head 14 during the passage of the paper P into that space. Note that the two guide rollers 20 and 22 are supported by the frame 10 through a suitable support structure, which is not shown. During the recording operation by the thermal head 14, the paper P is successively drawn out from the roll of paper RP, and thus the diameter of the roll of paper RP gradually becomes smaller and the weight of the roll of paper decreases. When the roll of paper RP is first loaded, that is, when the diameter of the roll of paper RP is large and the weight is relatively heavy, the roll of paper RP is held in a rotatable manner by the two pairs of support rollers 16. On the other hand, when the diameter of the roll of paper RP becomes small and the weight is relatively less, the roll of paper RP is made to rotate on the rib elements 18, but in this case since the contact area of the rib elements 18 with the roll of paper RP is small, the frictional resistance at the time of rotation of the roll of paper RP is also small.

Figure 2:
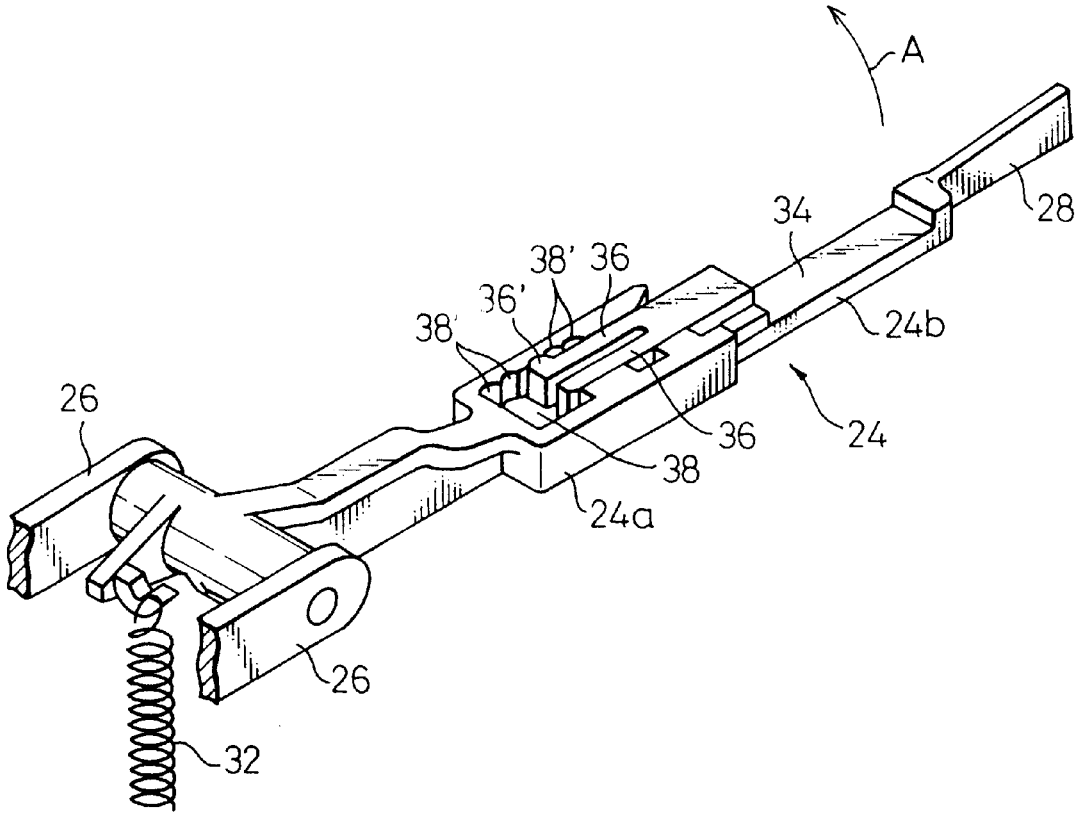
FIG. 2 is a perspective view showing in detail a lever element constituting a part of the detector according to the present invention.

A detector for detecting a near end state of the roll of paper according to the present invention is provided with a lever element 24, as shown in FIG. 2, as an element to be detected. The lever element 24 is built into the extending portion 10*b* of the frame 10 as shown in FIG. 1, and is arranged between the two rib elements 18 positioned in the middle of the rib elements 18. As shown in FIG. 2, one end of the lever element 24 is pivoted between a pair of mounting members 26 extending from the end wall of the extending portion 10*b*, while a piece 28 to be detected is projected from the other end. As shown in FIG. 1, the piece 28 to be detected is inserted inside through the opening 30 formed at the bottom side of the side wall of the standing portion 10*a* of the frame 10. A coil spring element 32 is made to act against the pivot end of the lever element 24, so the lever element 24 is elastically biased at all times in the direction shown by the arrow A (FIG. 2).

In this embodiment, the lever element 24 is divided into two portions, that is, a first portion 24*a* with the pivot end and a second portion 24*b* with the piece 28 to be detected, and the second portion 24*b* is movably connected to the first portion 24*a*. A recess 34 is formed in the second portion 24*b*, and has predetermined dimensions and shape. The position of the recess 34 is adjustable due to the movable connection of the second portion 24*b* to the first portion 24*a*. More specifically, two plate spring-like connecting pieces 36 project from the second portion 24*b*, and are slidably received and connected in a groove portion 38 formed in the first portion 24*a*. One of the plate spring-like connecting pieces 36 has a projection 36' integrally formed at a free end thereof, and one of the side wall surfaces of the groove portion 38 has several depressions 38' formed therein. As shown in FIG. 2, the projection 36' can be elastically engaged with one of the depressions 38'. In short, by selecting the engagement position of the projection 36', the position of the recess 34 of the second portion 24*b* is adjustable. Note that the significance of the adjustment of the position of the recess 34 will be explained in detail later.

Further, the near end detector according to the present invention comprises a gate-like element 40 as an optical detection means, which is provided inside the standing portion 10*a* of the frame 10, as shown in FIG. 1. A light receiving element is built into one leg portion of the gate-like element 40, while a light emitting element such as a semiconductor laser is built in the other leg portion. The light beam is emitted from the light emitting element toward the light receiving element. Note that in FIG. 3 to FIG. 5, the light beam is shown by the reference characters LB. The piece 28 of the lever element 24 is received in the gate-like element 40, and is used to detect the near end state of the roll of paper RP in the manner described below.

When the roll of paper RP is loaded in the roll of paper holding space of the frame 10, as shown in FIG. 1, the lever element 24 is stopped at a first position, that is, a pushed-in position, against the elastic force of the coil spring element 32 due to the weight of the roll of paper RP. At that time, the piece 28 of the lever element 24 is placed at a lower position in the gate-like element 40, so it will not cut off the light beam traversing the inside of the gate-like element 40. In FIG. 1, the roll of paper RP is one without a core, but the same is true for a roll of paper with a core.

Figure 3:
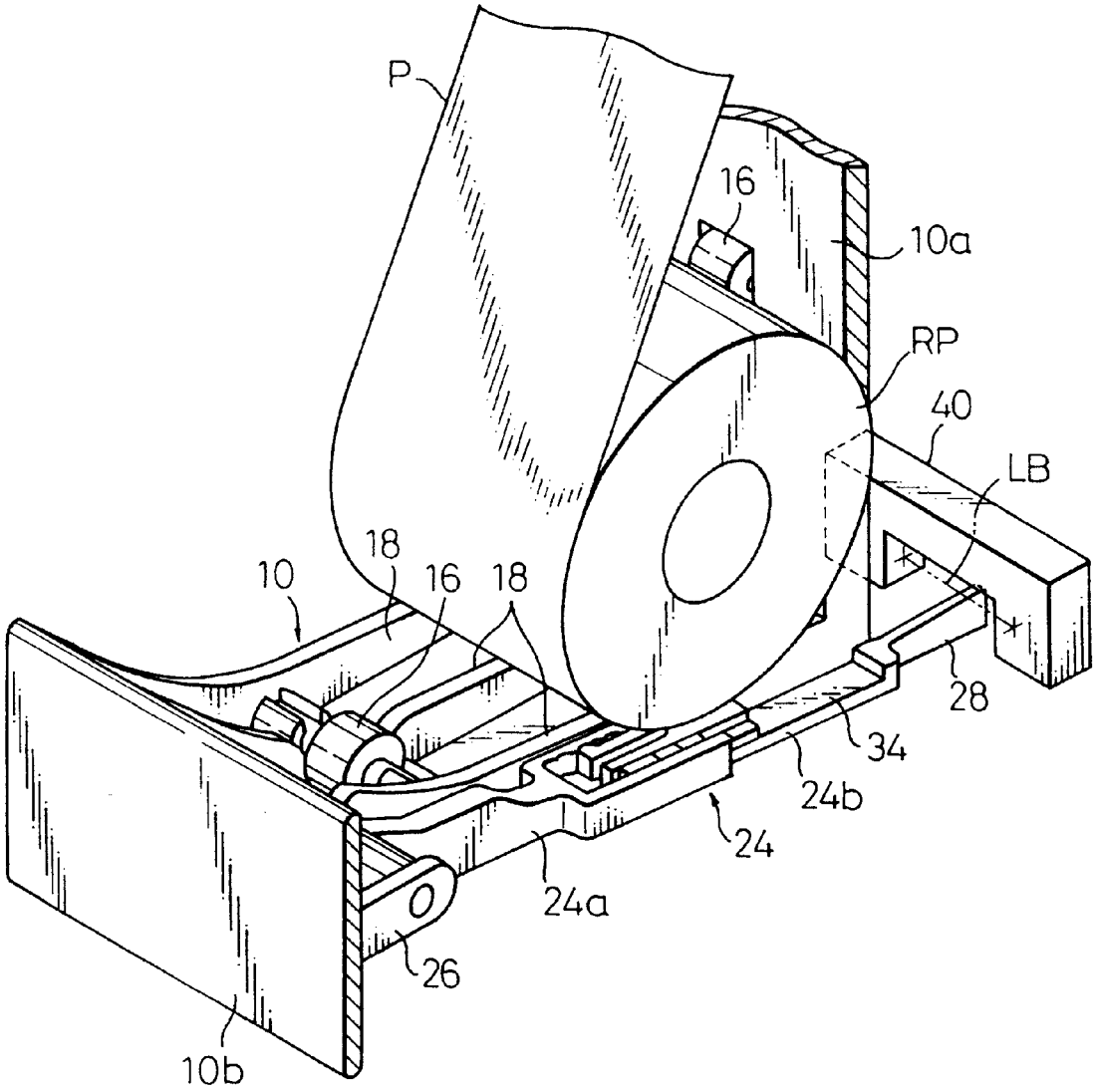
FIG. 3 is a partially cutaway enlarged perspective view of the printer shown in FIG. 1, which shows a coreless roll of paper before the near end state thereof.
Figure 4:
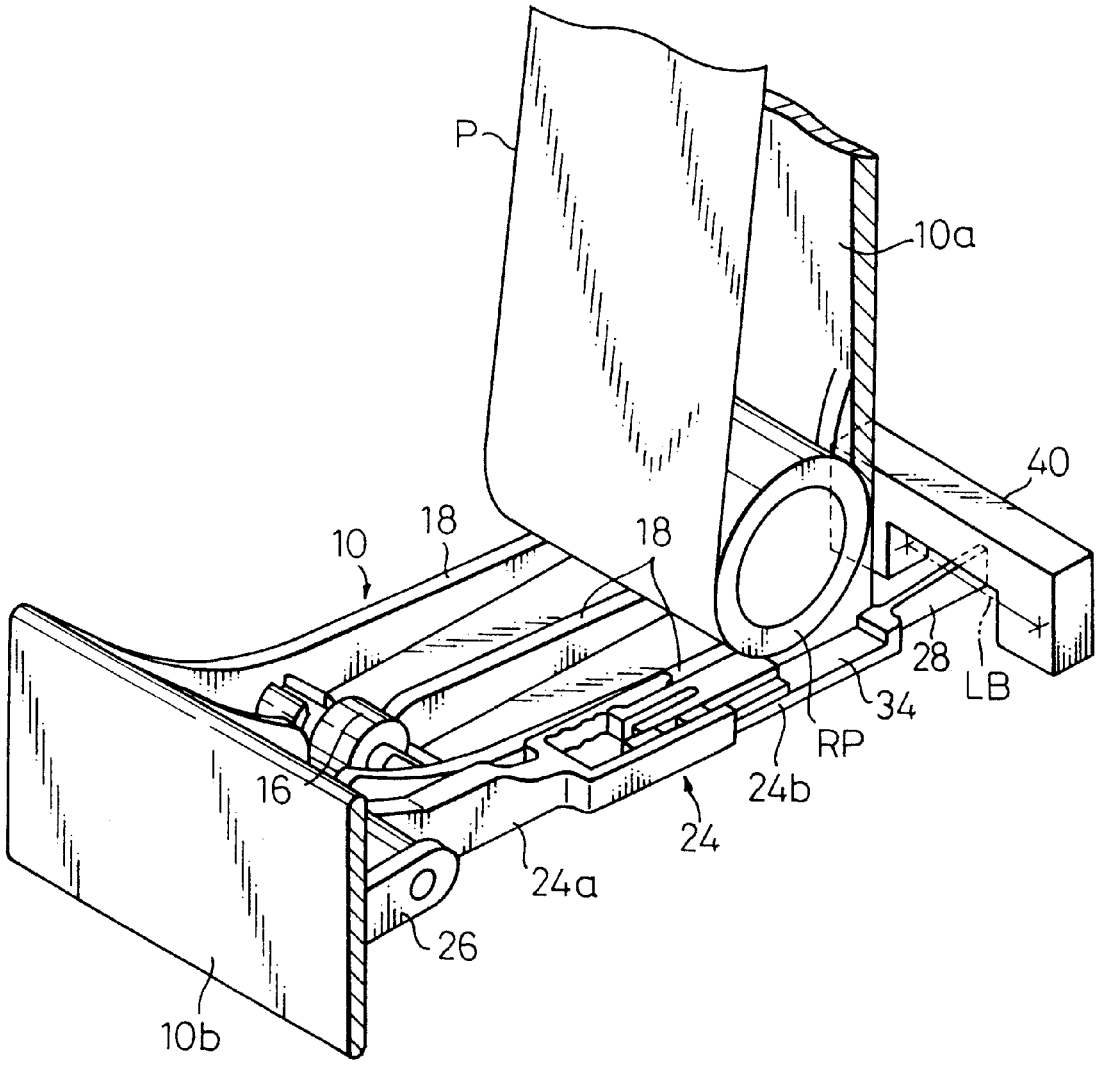
FIG. 4 is a partially cutaway enlarged perspective view similar to that of FIG. 3, which shows a coreless roll of paper in the near end state.

FIG. 3 shows the state of a considerable amount of paper P being drawn out from the roll of paper RP without a core and the remaining amount approaching the near end state, but the lever element 24 is still stopped at the pushed-in position by the weight of the roll of paper RP, so the light beam LB traversing the inside of the gate-like element 40 is not cut off by the piece 28 of the lever element 24. FIG. 4 shows the state where the remaining amount of the roll of paper RP has reached the near end state. At this time, the coil spring element 32 is able to overcome the weight of the roll of paper RP. Thus, the lever element 24 is moved from the pushed-in position to a second position, that is, an abutting position where the piece 28 of the lever element 24 abuts against the bottom surface of the top portion of the gate-like element 40. As a result, the light beam traversing the inside of the gate-like element 40 is cut off and a detection signal is output from the light receiving element built into one of the leg portions of the gate-like element 40. In short, when the roll of paper RP does not have a core, the near end state of the roll of paper RP is detected by detecting its weight.

Figure 5:
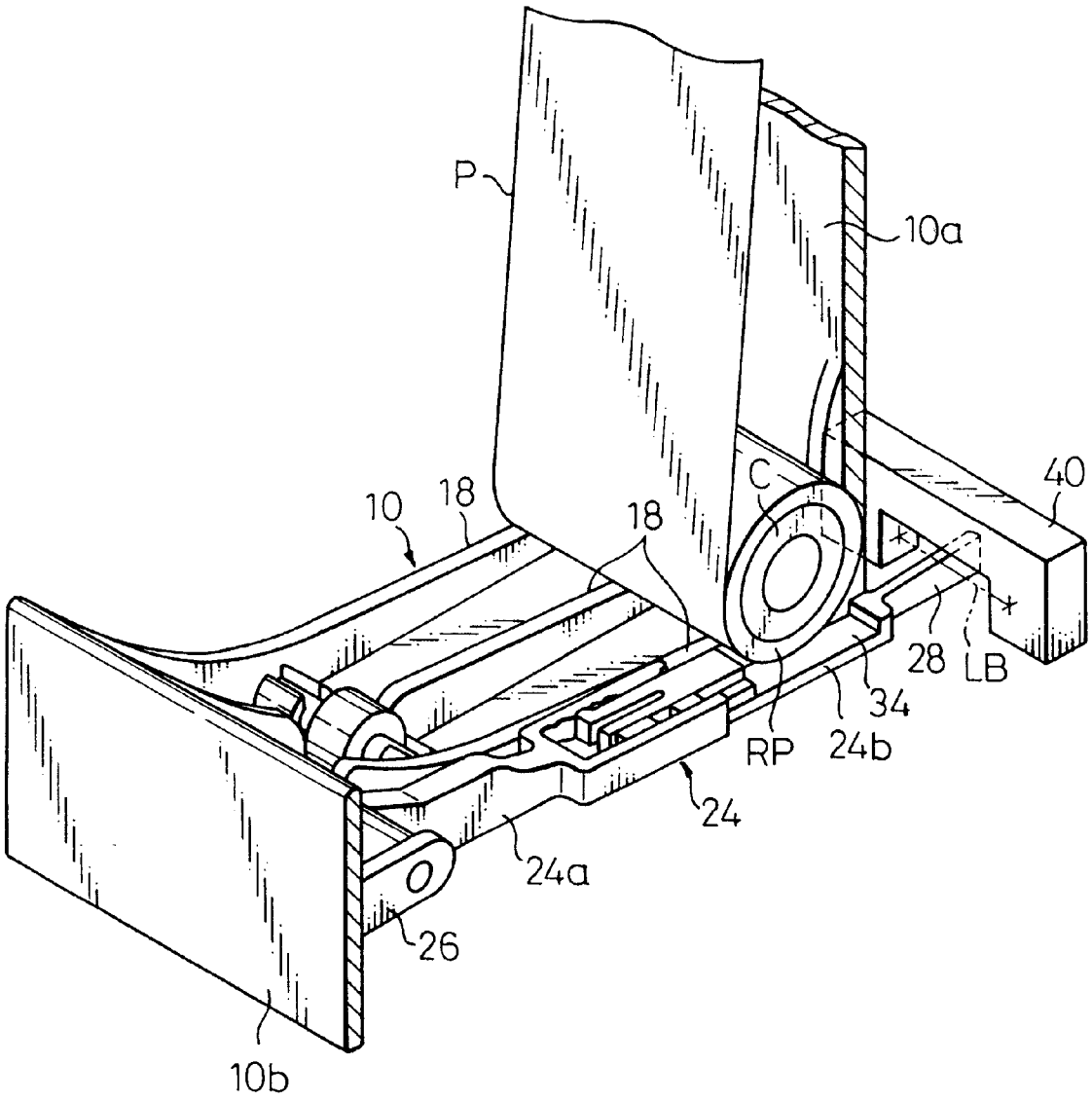
FIG. 5 is a partially cutaway enlarged perspective view similar to that of FIG. 4, which shows a roll of paper, with a core, in the near end state.

FIG. 5 shows the state where the remaining amount of the roll of paper RP with a core has reached the near end state. The weight of the core C included in the roll of paper RP with a core has a magnitude such that it can by itself stop the lever element 24 at the first position, that is, the pushed-in position, but when the remaining amount of the roll of paper RP with a core reaches the near end state, the diameter is reduced to an extent enabling the roll of paper RP with a core to be received in the recess 34 of the lever element 24. At this time, the pressing force from the roll of paper RP with the core on the lever element 24 is released, so the lever element 24 is moved from the first position to the second position in the same way as with the case of a roll of paper RP without a core by the elastic force of the coil spring element 32. As a result, in the same way as the above case, a detection signal is output from a light receiving element built in one of the leg portions of the gate-like element 40.

Figure 6:
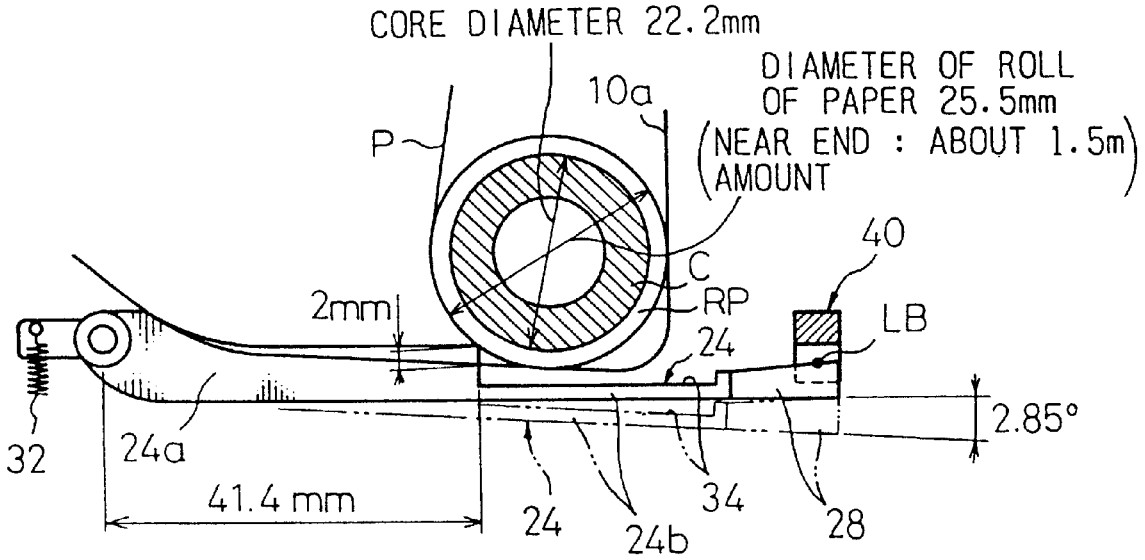
FIG. 6 is a side view of FIG. 5 which shows an example of an adjustment of the lever element.

There are various diameter sizes of the core of the roll of paper on the market on market. To suitably detect the near end states of these respective various rolls, it is necessary to adjust the position of the recess 34 of the lever element 24. As mentioned above, according to this embodiment, by making the second portion 24*b* move with respect to the first portion 24*a* of the lever element 24, it is possible to adjust the position of the recess 34, so it is possible to suitably detect the near end state of rolls of paper having cores of different core diameters. Of course, the larger the core diameter, the closer the recess 34 is set to the position of the pivot side end of the lever element 24, while the smaller the core diameter, the closer the recess 34 is set to the position of the detection end of the lever element 24. For example, in the case where the core diameter of the roll of paper is 22.2 mm, and where the near end state (i.e., the remaining paper length) of the roll of paper is made 1.5 m, it is sufficient to detect when the total diameter of the roll of paper becomes 25.5 mm. In this case, as shown in FIG. 6, one step portion of the recess 34, that is, the step portion at the pivot side of the lever element 24, is positioned to be 41.4 mm from the pivot center. With this arrangement, if the total diameter of the roll of paper falls to 25.5 mm, the lever element 24 swivels 2.85 degrees from the pushed-in position due to the elastic force of the coil spring element 32. At this time, the piece 28 of the lever element 24 rises about 2 mm in the vertical direction and cuts off the light beam LB.

Figure 7:
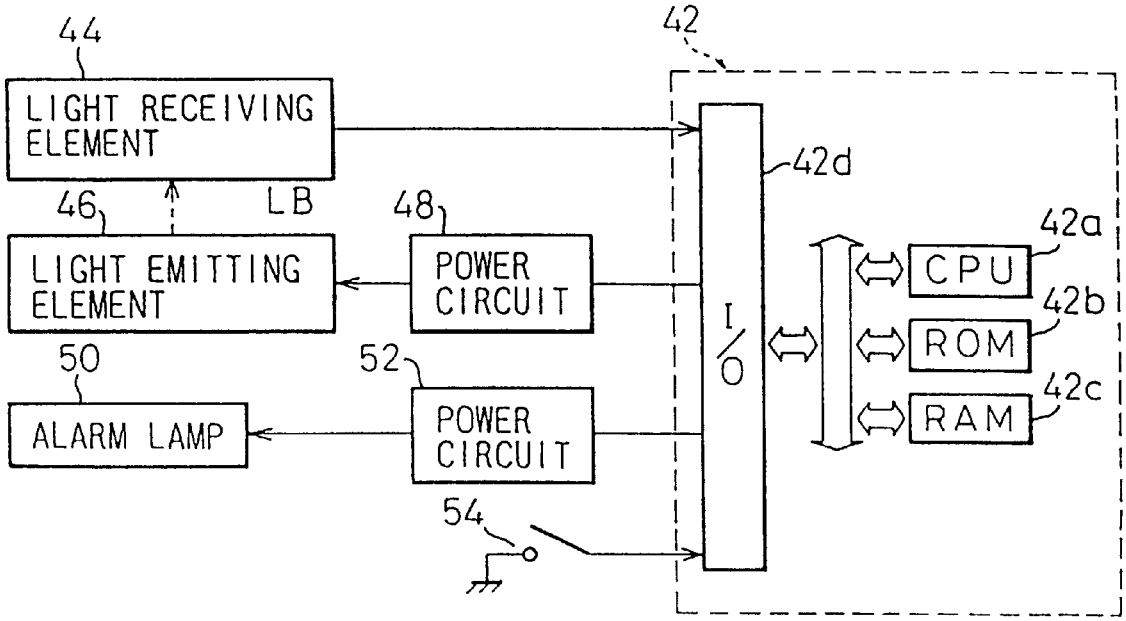
FIG. 7 is a block diagram of the controller of the detector according to the present invention.

When a detection signal is output from the light receiving element, it is possible to operate a suitable alarm means to warn the user that the remaining amount of the roll of paper has reached the near end state. FIG. 7 shows a block diagram of the control for this alarm system by way of example. In this drawing, reference numeral 42 shows a control circuit of a terminal of a POS system, by which control circuit 42 the near end detector according to the present invention is controlled. The control circuit 42 is comprised of a microcomputer which includes a central processing unit (CPU) 42*a,* a read only memory (ROM) 42*b* for storing various operational programs, constants, etc., a random access memory (RAM) 42*c* for storing temporarily data etc., and an input/output interface (I/O) 42*d.* In FIG. 7, the light receiving element built into one leg portion of the gate-like element 40 is indicated by reference numeral 44. The light emitting element built into the other leg portion of the gate-like element 40 is indicated by reference numeral 46. The light emitting element 46 is connected through a power circuit 48 to an input/output interface 42*d.* When an ON signal is output from the control circuit 42 to the power circuit 48, the light emitting element 46 is electrically energized and a light beam LB is emitted toward the light receiving element 44. While the light beam LB is incident on the light receiving element 44, the detection signal from the light receiving element 44 is at the low level "L", but once the incidence of the light beam LB to the light receiving element 44 is cut off, the detection signal from the light receiving element 44 rises from the low level "L" to the high level "H". Further, in FIG. 7, reference numeral 50 is an alarm lamp which is provided at a suitable location on the housing (not shown) of the printer shown in FIG. 1. This alarm lamp 50 is connected through the power circuit 52 to an input/output interface 42*d.* When an ON signal is output from the control circuit 42 to the power circuit 52, the alarm lamp 50 is electrically energized and is lit. Note that reference numeral 54 shows a power switch of a terminal of a POS system.

Figure 8:
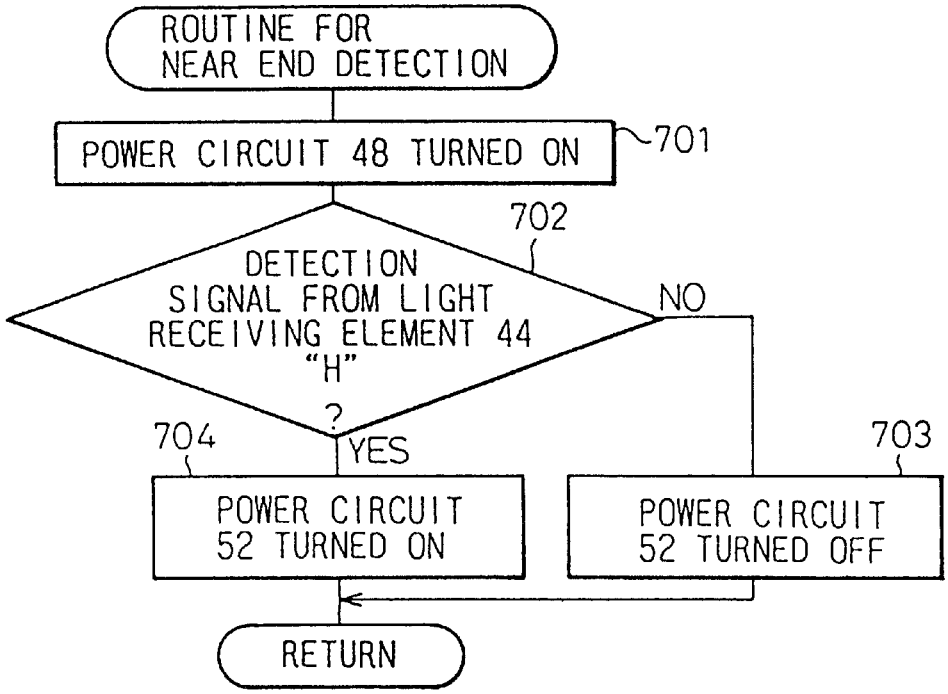
FIG. 8 is a flow chart for explaining the operation of the controller of FIG. 7.

Next, an explanation will be made of the operation of the near end detector according to the present invention referring to the near end detection routine shown in FIG. 8. The near end detection routine of FIG. 8 is an interruption routine. When the power switch 54 shown in FIG. 7 is turned ON, this routine is repeatedly executed at suitable time intervals, for example, every one second.

At step 701, an ON signal is output from the control circuit 42 to the power circuit 48 of the light emitting element 46, whereby a light beam LB is emitted from the light emitting element 46 toward the light receiving element 44. Then, at step 702, the signal from the light receiving element 44 is monitored. This monitoring may be performed at one second intervals. As mentioned above, the signal from the light receiving element 44 is held at the low level "L" while the light beam LB is incident on the light receiving element 44, but once the emission of the light beam LB to the light receiving element 44 is cut off, the signal rises from the low level "L" to the high level "H". The disappearance of the light beam LB at the light receiving element 44 is caused by the piece 28 of the lever element 24. This signifies that the remaining amount of the roll of paper RP is at the near end state.

When the detection signal from the light receiving element 44 is held at the low level "L", the routine proceeds from step 702 to step 703 and an OFF signal is output from the control circuit 42 to the power circuit 52 of the alarm lamp 50, so the alarm lamp 50 will not light up. On the other hand, when the detection signal from the light receiving element 44 rises to the high level "H", the routine proceeds from step 702 to step 704. At this time, an ON signal is output from the light receiving element 44 to the power circuit 52 of the alarm lamp 50, whereby the alarm lamp 50 is lit and the user is warned that the roll of paper RP is near its end. This enables the user to insert a new roll of paper into the printer at a suitable time.

In the above embodiment, the near end detector according to the present invention is used for a printer of a terminal of a POS system, but needless to say it may also be used for other recording apparatuses, such as a facsimile. Further, in the above embodiment, an optical detecting means was used for detecting the piece 28 of the lever element 24, but use may also be made of other detecting means, for example, a microswitch.

As is clear from the above description, with the near end detector according to the present invention, it is possible to suitably detect the near end state of the paper roll without regard to whether the roll of paper has a core or not so, unlike the prior not, there is no limitation on the type of the roll of paper which may be used.

Finally, it will be understood by persons skilled in the art that the foregoing description is of preferred embodiments of the present invention, and that various changes and modifications can be made without departing from the spirit and scope thereof.

What is claimed is:

1. A device for detecting a near end state of a roll of paper, comprising:

holding means for rotatably holding a roll of paper so as to allow paper to be drawn out from the roll of paper, the holding means having a standing portion against which the roll of paper rests;

a pivot device built into said holding means, the pivot device being movable between a first position and a second position, the pivot device having a recess with a step portion;

elastic member to resiliently bias said pivot device to the second position;

said pivot device being moved to said first position against biasing force of said elastic member by the weight of the roll of paper when the roll of paper is held in said holding means;

in the case where the roll of paper is coreless, said pivot device being moved from the first position to the second position by the bias force of the elastic member when the weight of the roll of paper is reduced to a predetermined value by the drawing out of the paper therefrom;

in the case where the roll of paper has a core, said pivot device being moved from the first position to the second position by the bias force of the elastic member when the diameter of the roll of paper is reduced to a predetermined value, by the drawing out of the paper therefrom, so the roll of paper is received in the recess of said pivot device; and a detector to detect when said pivot device moves from the first position to the second position.

2. A device as set forth in claim 1, wherein a position of the step portion of said pivot device with respect to the standing portion is adjustable in accordance with a size of the core of a roll of paper with a core.

3. A device as set forth in claim 1, further comprising an alarm for warning that the remaining amount of the roll of paper has reached the near end state when the movement of said pivot device from the first position to the second position is detected by said detector.

4. A device as set forth in claim 3, wherein a position of the step portion of said pivot device with respect to the standing portion is adjustable in accordance with a size of the core of a roll of paper with a core.

5. A device as set forth in claim 1, wherein the standing portion comprises support rollers and rib elements.

* * * * *